US005350241A

United States Patent [19]

Zoland

[11] Patent Number: 5,350,241

[45] Date of Patent: Sep. 27, 1994

[54] EXPANDING DEVICE FOR COLLAPSIBLE ARTICLES

[76] Inventor: Martin Zoland, P.O. Box 68, Hawksburn, Victoria, Australia

[21] Appl. No.: 866,185

[22] PCT Filed: Jul. 18, 1991

[86] PCT No.: PCT/AU91/00321

§ 371 Date: Jun. 29, 1992

§ 102(e) Date: Jun. 29, 1992

[87] PCT Pub. No.: WO92/01404

PCT Pub. Date: Feb. 6, 1992

[51] Int. Cl.[5] ..... A45C 7/00

[52] U.S. Cl. ..... 383/127; 383/33

[58] Field of Search ..... 383/33, 127; 229/120.07, 120.33, 120.36, 120.31

[56] References Cited

U.S. PATENT DOCUMENTS

| | | | |
|---|---|---|---|
| 3,383,027 | 5/1968 | Brinkama et al. | 229/120.07 |
| 4,946,292 | 8/1990 | Diamond et al. | 383/127 |
| 4,969,751 | 11/1990 | Diamond et al. | 383/127 |
| 4,993,846 | 2/1991 | Diamond et al. | 383/127 |
| 5,030,014 | 7/1991 | Diamond et al. | 383/127 |
| 5,179,600 | 1/1993 | Bailey et al. | 383/127 |

*Primary Examiner*—Allan N. Shoap
*Assistant Examiner*—Jes F. Pascua
*Attorney, Agent, or Firm*—Blakely, Sokoloff, Taylor & Zafman

[57] ABSTRACT

An expanding device for a collapsible article, comprising engaging portions disposed, in use, at respective opposite locations adjacent or at joins of at least one wall of the article and resilient elements which, on release of forces holding the article in a collapsed state, acts on the engaging portions to cause the engaging portions to act on the joins or portions of the article adjacent thereto so as to expand the article for display purposes.

16 Claims, 4 Drawing Sheets

EXPANDING DEVICE FOR COLLAPSIBLE ARTICLES

The present invention relates to an expanding device for collapsible articles, such as collapsible bags, and a collapsible article including an expanding device.

Commercial transport of goods is normally charged by volume as well as weight of the goods, and articles, such as bags, which can be collapsed for transport provide a distributor with significant cost savings. The disadvantage of such collapsible goods, however, is that on reaching their destination they invariably need to be expanded so as to present an attractive appearance and thereby enhance sale prospects. Purchasers of collapsible goods normally spend an inordinate amount of time filling the goods with costly inserts and foam material so the goods can be presented in an expanded form.

A number of devices have been proposed in the past to try to alleviate the above problem but most have either proved ineffective, or relatively cumbersome and/or, expensive to implement.

An object of the present invention is to provide an effective and inexpensive expanding device for collapsible articles.

In accordance with the present invention there is provided an expanding device for a collapsible article comprising:

engaging portions disposed, in use, at respective opposite locations adjacent or at joins of at least one wall of said article and resilient means which, on release of forces holding said article in a collapsed state, acts on said engaging portions to cause said engaging portions to act on said joins or portions of said article adjacent thereto so as to expand said article for display purposes.

Preferably a first one of said engaging portions is brought toward a second one of said engaging portions to place said article in said collapsed state, the first and second engaging portions acting against said resilient means, and on release of said forces said resilient means acts to separate said first and second engaging portions until said article is expanded.

Preferably said first and second engaging portions are respectively disposed, in use, at or adjacent opposite joins of an end wall of said article and, on release of said forces, are separated by said resilient means until said end wall is fully extended.

Preferably said resilient means is connected between said first and second engaging portions.

Preferably said device includes first and second members pivotally connected to one another and comprising said first and second engaging portions, respectively and first and second extending portions which extend from said first and second engaging portions, respectively, said members each having first and second parts disposed on opposite sides of the pivotal connection therebetween, wherein said resilient means includes a first resilient band attached between the first part of the first member and the second part of the second member and a second resilient band attached between the first part of the second member and the second part of the first member.

Preferred embodiments of the present invention are hereinafter described, by way of example only, with reference to the accompanying drawings wherein.

Figure 1:
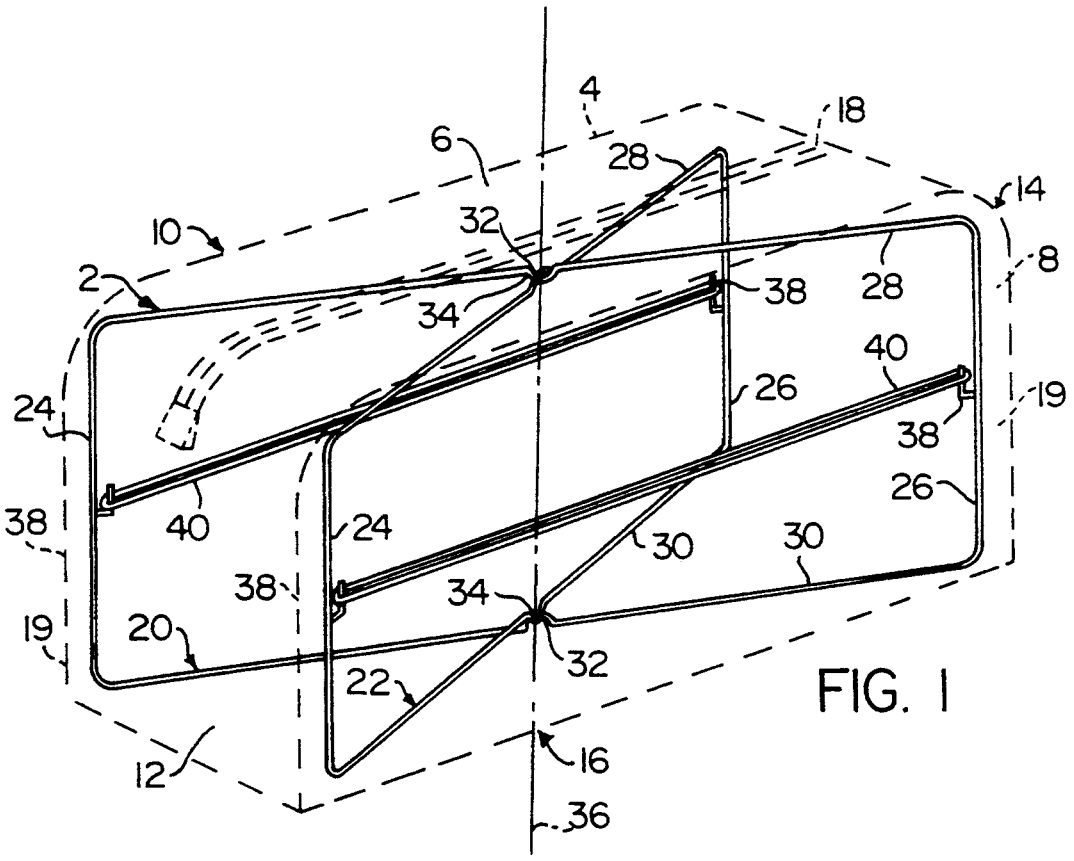
FIG. 1 is a perspective view of a first preferred embodiment of an expanding device in a collapsible bag.
Figure 2:
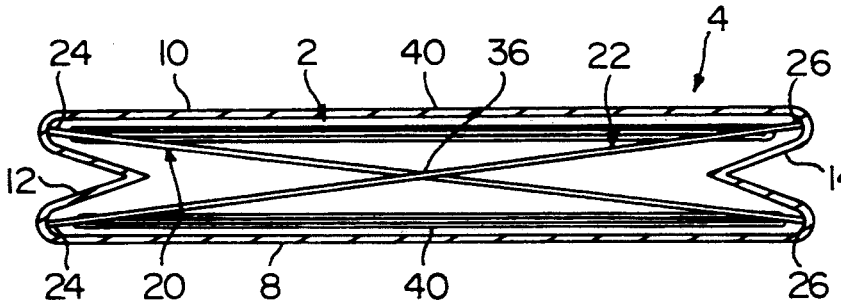
FIG. 2 is a plan view of the expanding device of FIG. 1 when the bag is collapsed.
Figure 3:
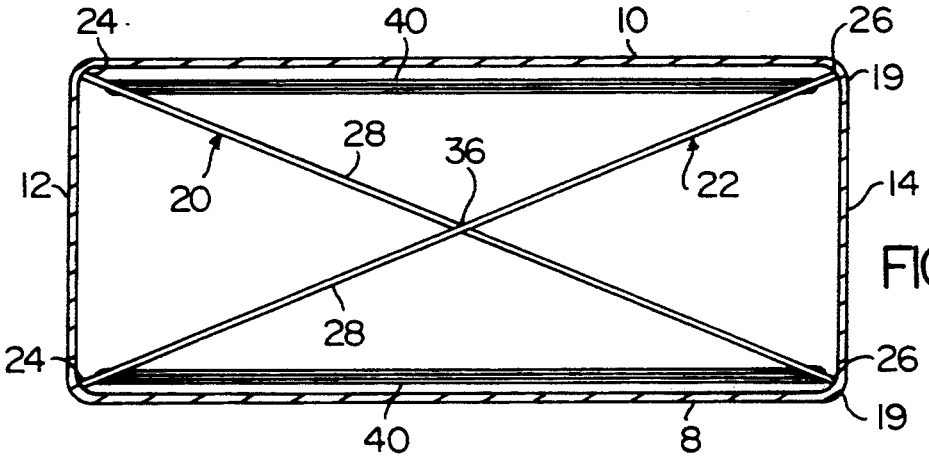
FIG. 3 is a plan view of the expanding device of FIG. 1 when the bag is expanded in its normal shape for displaying purposes.

An expanding device 2 is shown in FIG. 1 inserted in a collapsible bag 4. The bag 4 includes an upper wall 6, side walls 8 and 10, end walls 12 and 14, and a bottom wall 16, which are made of fabric material and are stitched together to form the bag 4. The upper wall 6 includes an opening formed by a zipper 18. The expanding device 2 includes two planar flames 20 and 22 which each extend diagonally across the bag 4. The flames 20 and 22 each include two opposing upright leg portions 24 and 26 which are connected at their ends by an upper arm portion 28 and a lower arm portion 30. The arm portions 28 and 30 of the first frame 20 include indents 32 disposed in the middle of the arms 28 and 30 and the other frame 22 includes corresponding protrusions 34 disposed in the middle of its arms 28 and 30. By making the height of the second frame 22 less than the height of the first frame 20, or alternatively reducing the height just in the region of the protrusions 34, the protrusions 34 can be hooked onto the indents 32, as shown in FIG. 1, so the flames 20 and 22 are pivotally connected to one another, and can pivot with respect to one another about a central vertical axis 36. The legs 24, 26 also include hooks 38 to which resilient bands 40 can be attached. The resilient bands 40 may be rubber bands or bands formed of any other elastic material. A first band 40 is hooked between the first leg 24 the first frame 20 and the second leg 26 of the second frame 22 and another band 40 is hooked between the first leg 24 of the second frame 22 and the second leg 26 of the first frame 20, as shown in FIGS. 1 to 3. The frames 20, 22 are preferably formed of plastic material by injection moulding or of metal wire. The frames 20, 22 may also be substituted by two cardboard sheets, with appropriate hook portions for the resilient bands 40, and the edges of the sheets act as the arms 28, 30 and legs 24 and 26. One of the sheets is provided with an upper central vertical slit and the other sheet includes a lower central vertical slit to enable the sheets to be slotted together so that they can pivot with respect to one another about a central axis in the same manner as the frames 20 and 22. The sheets need only pivot within a limited angular range between an expanded and a collapsed position, as described hereinafter with reference to FIGS. 2 and 3.

The legs 24 and 26 are disposed adjacent the joins 19 between the side and end walls 8, 10, 12 and 14. The joins 19 are preferably reinforced by gussets and the legs 24 and 26 may be attached to the gussets or inserted in loops formed by material attached to the gussets, as described hereinafter with reference to FIG. 4. The height of the legs 24 and 26 and the flames 20 and 22 may be varied as desired to provide the bag 4 with the required appearance for display purposes.

The bag 4 is collapsed for transport by folding the end walls 12 and 14 and moving the side walls 10 and 8 towards one another so as to be preferably placed against each other. Accordingly, the flames 20 and 22 are pivoted with respect to one another about the central axis 36 so as to move the two first legs 24 towards one another and the other two second legs 26 towards one another. Moving the legs 24 and 26 in this manner stretches the resilient bands 40 and places them in tension. External forces need to be applied to maintain the bag 4 and the expanding device 2 in the collapsed state and this can be achieved by binding the bag 4, placing it in appropriate plastic bag, or packaging the bag with other bags between the walls of a box or crate for transport. On releasing the external forces, the resilient bands act to try return to a normal state and force their respective first legs 24 and second 26 towards one another, which in turn forces the first legs 24 of the frames 20 and 22 apart and the second legs 26 of the frames 20 and 22 apart, as shown in FIG. 3. The legs 24 and 26 act on the bag 4 to move the side walls 8 and 10 apart until the end walls 12 and 14 are fully extended, as shown in FIG. 3. The resilient bands 40 are inhibited from pivoting the frames 20 and 22 by virtue of the engagement of the legs 24 and 26 with the side walls 8 and 10, which cannot be moved apart any further than the width of the end walls 12 and 14. The bag 4 is now fully expanded, as shown in FIG. 1, and ready for display.

Figure 4:
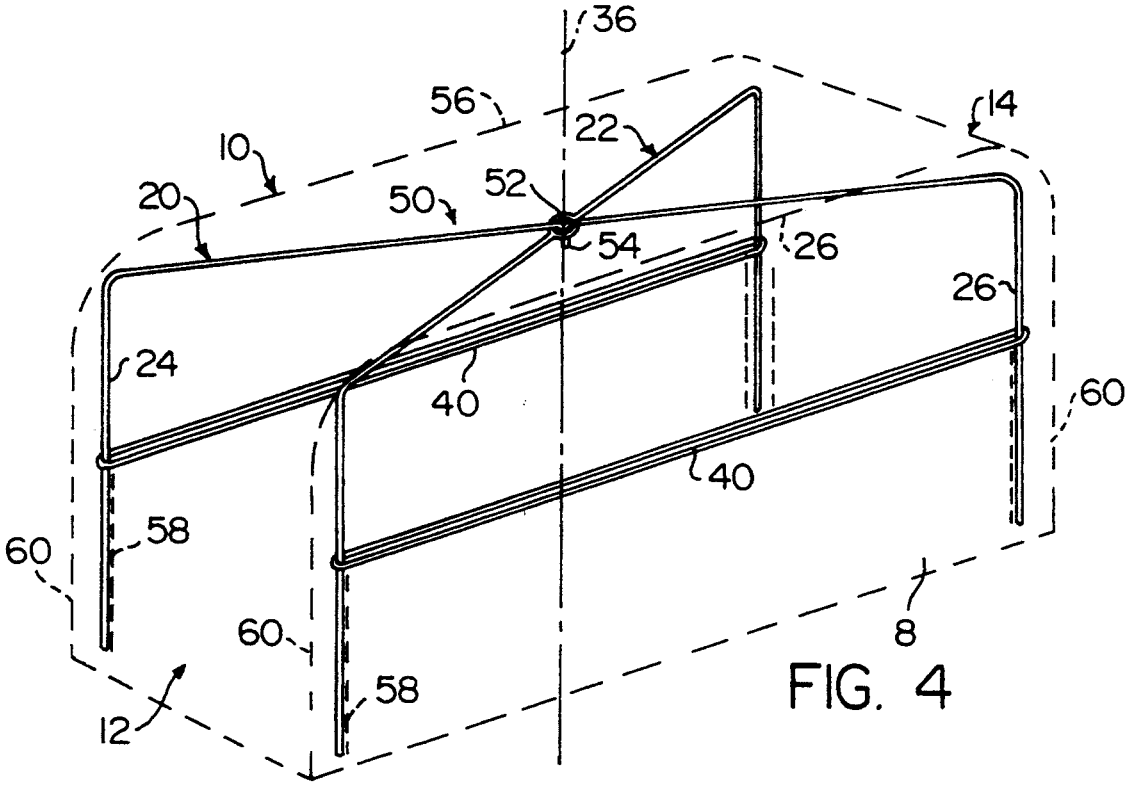
FIG. 4 is a perspective view of a second preferred embodiment of an expanding device in a collapsible bag.

A second expanding device 50, as shown in FIG. 4, is essentially the same as the expanding device 2 described previously but the frames 20 and 22 do not include the lower arm portions 30. The device 50 also adopts an alternative method of pivotally connecting the frames 20 and 22 at the central axis 36. The first frame 20 includes a central downwardly extending pin 54 which is received by a corresponding opening defined a central annular ring 52 included in the second frame 22. The expanding device 50 is placed in a bag 56, which is the same as the bag 4, except the bag 56 includes looped material 58 attached to each gusset 60 provided in the joins between the ends walls 12 and 14 and the side walls 8 and 10. The looped pieces of material 58 define respective pockets which partially extend along the gusset 60 and are adapted to receive the bottom ends of the legs 24 and 26 of the frames 20 and 22, as shown in FIG. 4. The bands 40 are attached to the legs 24 and 26 just above the pockets defined by the pieces of material 58, which can also act to prevent the bands 40 sliding down the legs 24 and 26. The looped pieces of material 58 effectively attach the legs 24 and 26 to the gussets 60 and this advantageous as the legs 24 and 26 then act more on the gussets 60 than the side walls 8 and 10 when expanding the bag 56, which lessens the strain on the joins 19 and improves the ability of the device 50 to expand the bag 56.

Figure 5:
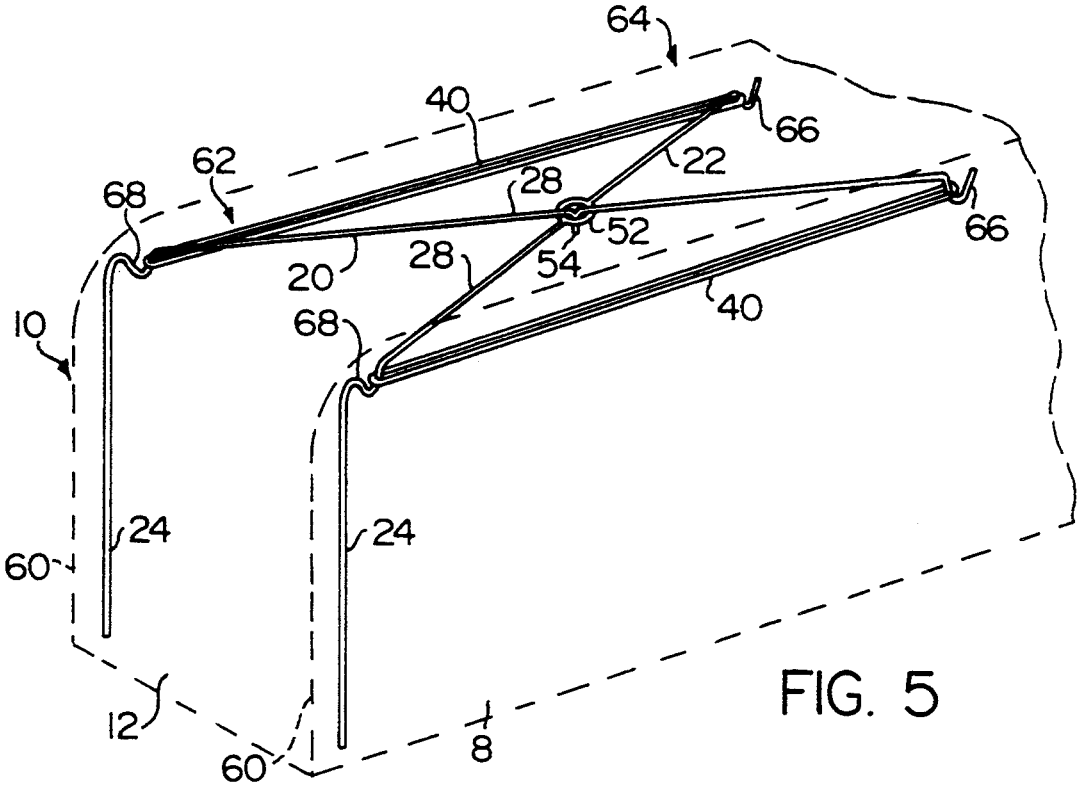
FIG. 5 is a perspective view of a third preferred embodiment of an expanding device shown in part of a collapsible bag.

A third expanding device 62 is illustrated in FIG. 5 disposed in one end of a collapsible bag 64. The expanding device 62 may be used in large collapsible bags 64 where it is impractical for the frames 20 and 22 to extend across the entire bag 64 to diagonally opposite ends thereof. Instead, two expanding devices 62 are employed at respective ends of the bag 64. The third expanding device 62 is the same as the second expanding device described with reference to FIG. 4, except the frames 20 and 22 do not include the second legs 26 and the arms 28 are terminated with hooks 66, a short distance past the pivotal connection provided by the pin 54 and ring 52. Also the arms 28 include indents 68 disposed adjacent the legs 24, and each of the two bands 40 is hooked between an indent 68 of one arm 28 and a hook 66 of the other ann 28, as shown in FIG. 5. The expanding device 62 acts to expand the bags 64 from the collapsed position by the bands 40 causing the legs 24 to act on the gussets 60, or the side walls 8, 10, as described previously, and it should be noted that it is not necessary for the hooks 66 to make contact with any part of the bag 64.

A collapsible bag 102, as shown in FIGS. 6 to 9, also includes an upper wall 104, a bottom wall 106, two side walls 108 and 110 and end walls 112 and 114, which are all made of fabric material. The walls are stitched together at the edges thereof to form the bag 102 and are preferably reinforced by gussets 116 formed at the joins between the walls. The bag 102 has handles 116 and 118 attached to the side walls 108 and 110 and a zipped opening 120 disposed across the upper wall 104.

Figure 6:
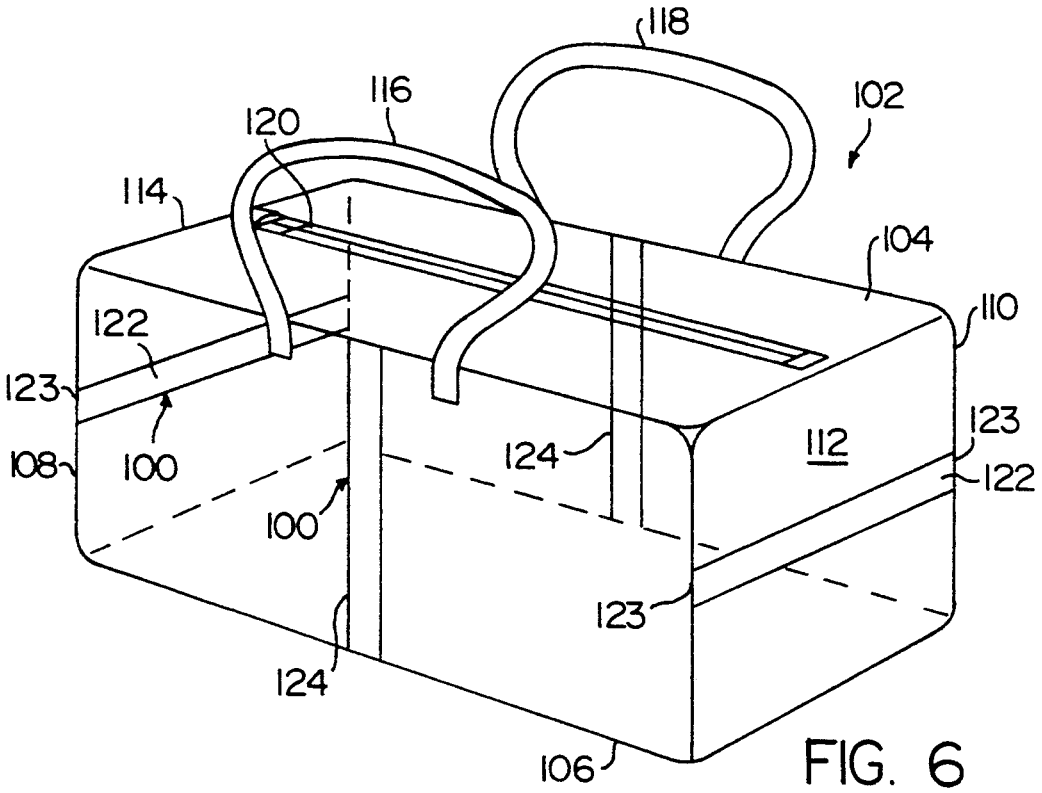
FIG. 6 is a schematic view of an expanded collapsible bag which includes a fourth preferred embodiment of an expanding device.

The bag 102 includes a fourth expanding device 100 which comprises resilient strips or rods 122, 124 which extend across respective walls of the bag 102. The strips or rods 122, 124 support the bag by acting on the gussets 116 to space the edges of the walls so as to cause the bag 102 to remain in an expanded form and thereby present an attractive appearance for display purposes. The number of strips 122 and 124 employed and the positioning of the strips 122 and 124 depends on the shape and form of the bag to be expanded. The strips or rods 122 and 124 are formed of tensile metal or plastic. For the bag illustrated in FIG. 6, horizontal strips 122 are required to extend across the end walls 112 and 114, respectively, and vertical strips 124 are required to extend across the side walls 108 and 110, respectively. To reduce the number of strips required, the strips 122 and 124 are disposed in the middle of the respective walls 108, 110, 112, 114 as shown in FIG. 6. The strips 122 and 124 are inserted into the bag 102 by attaching the ends of the strips to the edges of their respective walls.

Figure 7:
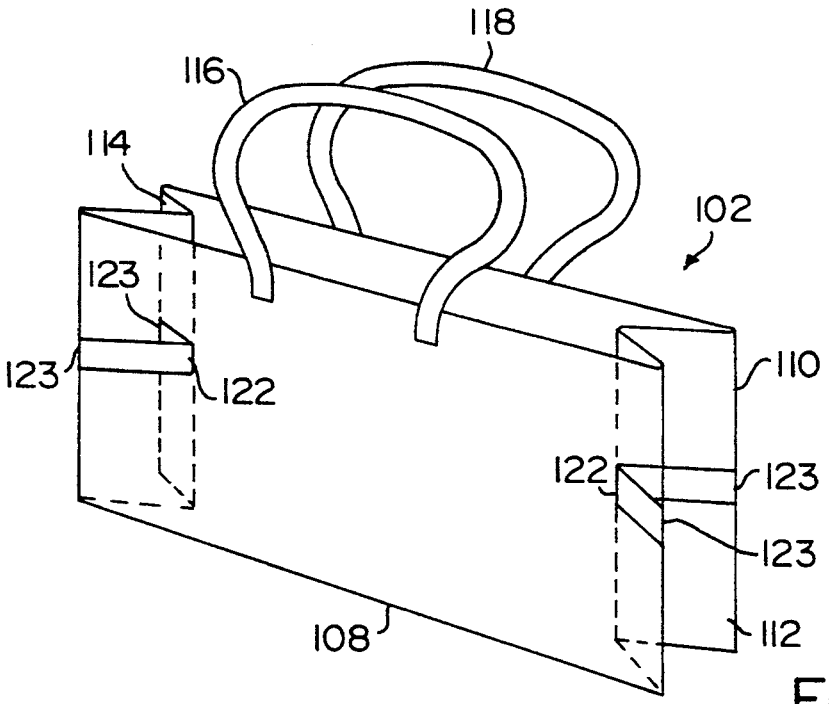
FIG. 7 is a schematic view of the bag of FIG. 6 when collapsed.
Figure 9:
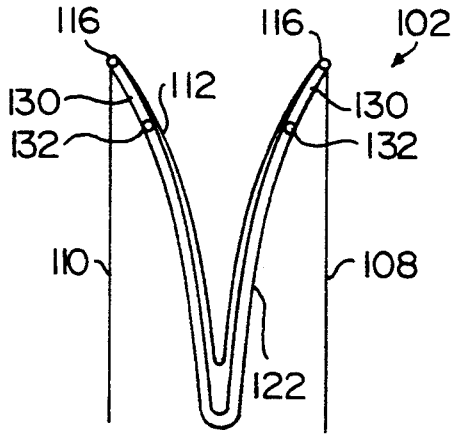
FIG. 9 is a plan cross-sectional view of the side wall of FIG. 6 when the bag is collapsed.

For transport, the bag 102 is compressed, as shown in FIG. 7, by folding the end walls 112 and 114 so as to ranch the bag 102. When the end walls 112 and 114 are folded, the respective strips 122 are deformed or bent at their middle portions, in a corresponding manner as shown in FIGS. 7 and 9. The bag 102 is held in a compressed or flat state during transport preferably by an additional holding means, such as a latch or an elastic band. The bag 102 may also be held in a compressed state by virtue of the manner in which the bag 102 is packed with other bags for transport, as discussed previously.

On arriving at a desired destination, the compressive forces which are exerted on the bag to retain it in a compressed state can be released an on doing so, the resilient nature of the strips 122 causes them to return to their normal form, as shown in FIG. 1. On returning to their normal form, the ends 123 of the strips 122 act on the side walls 10& and 110 to cause the respective walls 112 and 114 to become unfolded, thereby returning the bag 102 to an expanded state ready for display.

Figure 8:
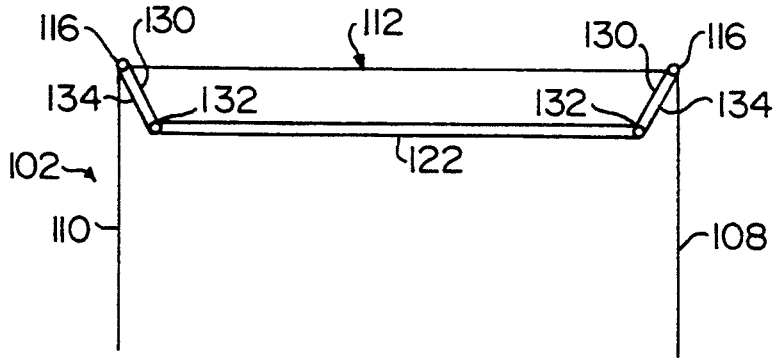
FIG. 8 is a plan cross-sectional view of one of the side walls of the bag of FIG. 6.

A purchaser normally would not wish the resilient strips 122 and 124 to be retained in the bag and therefore the strips 122 and 124 are attached to the edges of the respective walls so they can be easily removed from the bag 102 after sale. One method of attaching the strips 122 to the bag 102 is illustrated in FIG. 8 where rigid inserts 130 are sewed into the gussets 116 of the bag 102. The free ends of the inserts 130 include eyelets 132 for attachment to respective ends of a resilient strip or rod 122. The inserts 130 include perforations 134 disposed across the inserts which enable a purchaser or salesperson to easily tip the inserts 130 so the strip 122 can be removed from the bag 102.

It should be appreciated from the above that the described embodiments of the expanding device are all inexpensive to implement. The expanding device is particularly advantageous as it does not require any planar sheets of cardboard to be inserted across the side walls of a collapsible bag to act on the walls when the bag is expanded from a collapsed state.

I claim:

1. An expanding device in combination with a collapsible article, said article having a plurality of walls, each wall having a plurality of edges, such that pairs of edges of adjacent intersecting walls are coupled to each other by a corresponding join, wherein said walls collapse when forces are applied to said walls, said expanding device comprising:

a) first and second engaging portions, each of said engaging portions touching two of, and only two of, said joins at opposing edges of at least three of said walls; and b) first and second resilient means, coupled to said engaging portions, for acting on said engaging portions to expand said article for display purposes when said forces are released.

2. The expanding device as claimed in claim 1, wherein said forces bring said first engaging portion toward said second engaging portion to place said article in said collapsed state, the first and second engaging portions acting against said first and second resilient means, and on release of said forces, said first and second resilient means act to separate said first and second engaging portions until said article is expanded.

3. The expanding device as claimed in claim 2, (a) wherein said article has one end wall, two side walls, and a first join and a second join formed by said end wall and two side walls; and (b) wherein said first engaging portion only touches said article at said first join and said second engaging portion only touches said article at said second join and, on release of said forces said engaging portions are separated by said first and second resilient means until said end wall is fully extended.

4. The expanding device as claimed in claim 3, wherein said first and second resilient means are connected to first and second engaging portions.

5. The expanding device as claimed in claim 3, including first and second members coupled through a pivotal connection and comprising said first and second engaging portions, respectively, and first and second extending portions extending from said first and second engaging portions, respectively, said members each having first and second parts disposed on opposite sides of the pivotal connection therebetween, wherein said first and second resilient means include a first resilient band attached between the first part of the first member and the second part of the second member and a second resilient band attached between the first part of the second member and the second part of the first member.

6. The expanding device as claimed in claim 5, wherein the walls of said collapsible article adjacent to said engaging portions prevent said resilient bands from separating said engaging portions beyond a predetermined distance.

7. An expanding device as claimed in claim 6, wherein said members comprise two sheets of pivotally connected cardboard.

8. The expanding device as claimed in claim 7, wherein said members comprise two sheets of pivotally connected cardboard.

9. The expanding device as claimed in claim 5, wherein said first parts comprise said first and second engaging portions.

10. The expanding device as claimed in claim 9, (a) wherein said article has a second end wall disposed opposite to said first end wall; and (b) wherein said second parts comprise two further engaging portions which act to extend said second end wall on release of said forces.

11. An expanding device as claimed in claim 10, wherein said members comprise two sheets of pivotally connected cardboard.

12. An expanding device as claimed in claim 9, wherein said members comprise two sheets of pivotally connected cardboard.

13. The expanding device as claimed in claim 12, wherein said frames are made of injected molded plastic material.

14. The expanding device as claimed in claim 12, wherein said members comprise two sheets of pivotally connected cardboard.

15. The expanding device as claimed in claim 5, wherein said engaging portions comprise upright legs, said extending portions comprise arm portions, and said members comprise two pivotally connected planar frames.

16. An expanding device as claimed in claim 5, wherein said members comprise two sheets of pivotally connected cardboard.

* * * * *